US008057178B2

(12) United States Patent
Itzel et al.

(10) Patent No.: US 8,057,178 B2
(45) Date of Patent: Nov. 15, 2011

(54) TURBINE BUCKET FOR A TURBOMACHINE AND METHOD OF REDUCING BOW WAVE EFFECTS AT A TURBINE BUCKET

(75) Inventors: Gary Michael Itzel, Simpsonville, SC (US); Michael Adelbert Sullivan, Woodstock, GA (US); Yang Liu, Simpsonville, SC (US); Mahesh Madhukar Athavale, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 682 days.

(21) Appl. No.: 12/204,042

(22) Filed: Sep. 4, 2008

(65) Prior Publication Data

US 2010/0054954 A1 Mar. 4, 2010

(51) Int. Cl.
*F01D 5/08* (2006.01)

(52) U.S. Cl. ..... 416/97 R; 416/96 R

(58) Field of Classification Search ..... 416/96 R, 416/97 R

See application file for complete search history.

(56) References Cited

U.S. PATENT DOCUMENTS

| | | | | |
|---|---|---|---|---|
| 5,340,278 | A * | 8/1994 | Magowan | 416/96 R |
| 5,382,135 | A * | 1/1995 | Green | 416/97 R |
| 5,417,545 | A | 5/1995 | Harrogate | |
| 6,082,961 | A * | 7/2000 | Anderson et al. | 415/115 |
| 6,120,249 | A * | 9/2000 | Hultgren et al. | 416/97 R |
| 6,173,491 | B1 * | 1/2001 | Goodwater et al. | 29/889.1 |
| 6,341,939 | B1 * | 1/2002 | Lee | 416/97 R |
| 6,402,471 | B1 * | 6/2002 | Demers et al. | 416/97 R |
| 6,431,833 | B2 | 8/2002 | Jones | |
| 6,481,959 | B1 * | 11/2002 | Morris et al. | 415/115 |
| 6,506,016 | B1 * | 1/2003 | Wang | 415/173.7 |
| 7,806,650 | B2 * | 10/2010 | Heyward et al. | 415/115 |
| 2005/0095129 | A1 * | 5/2005 | Benjamin et al. | 416/97 R |
| 2006/0024164 | A1 * | 2/2006 | Keith et al. | 416/97 R |

* cited by examiner

*Primary Examiner* — Kiesha Bryant
*Assistant Examiner* — Mark Tornow
(74) *Attorney, Agent, or Firm* — Cantor Colburn LLP

(57) ABSTRACT

A turbine bucket for a turbomachine includes a main body portion having a base portion and an airfoil portion, the base portion includes a bucket cavity forward region and a shank cavity. The turbine bucket also includes a cooling channel that extends through the main body portion. At least one flow passage extends between one of the cooling channel and the shank cavity, toward the bucket cavity forward region. The at least one flow passage delivers a flow of cooling gas toward the bucket cavity forward region. The flow of cooling gas limits ingestion of hot gases into the bucket cavity forward region.

20 Claims, 7 Drawing Sheets

TURBINE BUCKET FOR A TURBOMACHINE AND METHOD OF REDUCING BOW WAVE EFFECTS AT A TURBINE BUCKET

BACKGROUND OF THE INVENTION

Exemplary embodiments of the present invention relate to the art of turbomachines and, more particularly, to a turbine bucket for a turbomachine.

In gas turbines, an axial gap exists between a trailing edge of an upstream nozzle side wall, and a leading edge of a downstream bucket platform. Hot gases exit upstream nozzle passages and pass over the axial gap before entering bucket row passages. A portion of the hot gases becomes stagnate at leading edge portions of the bucket platform. The stagnate flow or bow wave generates a circumferential pressure gradient at the axial gap. The circumferential pressure gradient generated by the bow wave drives hot gases to the axial gap and into a trench cavity area and may even reach a wheel space cavity area. The hot gases mix with cool purge flow passing through a wheel space portion of the turbine, travel circumferentially, and exit the trench cavity at a circumferential low pressure region. Hot gases reaching lower portions of the wheel space may cause damage and lower an overall operational life of the turbine. Increasing the cool purge flow to combat the detrimental effects of the hot gases lowers turbine efficiency.

BRIEF DESCRIPTION OF THE INVENTION

In accordance with an exemplary embodiment of the invention, a turbine bucket for a turbomachine includes a main body portion having a base portion and an airfoil portion, the base portion includes a bucket cavity forward region and a shank cavity. The turbine bucket also includes a cooling channel that extends through the main body portion. At least one flow passage extends between one of the cooling channel and the shank cavity toward the bucket cavity forward region. The at least one flow passage delivers a flow of cooling gas toward the bucket cavity forward region. The flow of cooling gas limits ingestion of hot gases into the bucket cavity forward region.

In accordance with another exemplary embodiment of the invention, a method of reducing bow wave effects at a turbine bucket includes delivering a cooling gas through a bucket cooling channel extending through the turbine bucket and along a shank cavity of the turbine bucket, passing a portion of the cooling gas through a flow passage that extends between one of the cooling channel and the shank cavity, and a bucket cavity forward region of the turbine bucket, and directing at least one jet of the portion of the cooling gas passing through the flow passage to oppose a local hot gas path pressure produced by a bow wave to limit ingestion of hot gases into the bucket cavity forward region.

In accordance with yet another exemplary embodiment of the invention, a turbomachine includes a turbine stage including a rotor disk, and a plurality of turbine buckets mounted to the rotor disk. Each of the plurality of turbine buckets includes a main body portion having a base portion and an airfoil portion, the base portion includes a bucket cavity forward region and a shank cavity. The turbine bucket also includes a cooling channel that extends through the main body portion. At least one flow passage extends between one of the cooling channel and the shank cavity toward the bucket cavity forward region. The at least one flow passage delivers a flow of cooling gas toward the bucket cavity forward region. The flow of cooling gas limits ingestion of hot gases into the bucket cavity forward region.

DETAILED DESCRIPTION OF THE INVENTION

Figure 1:
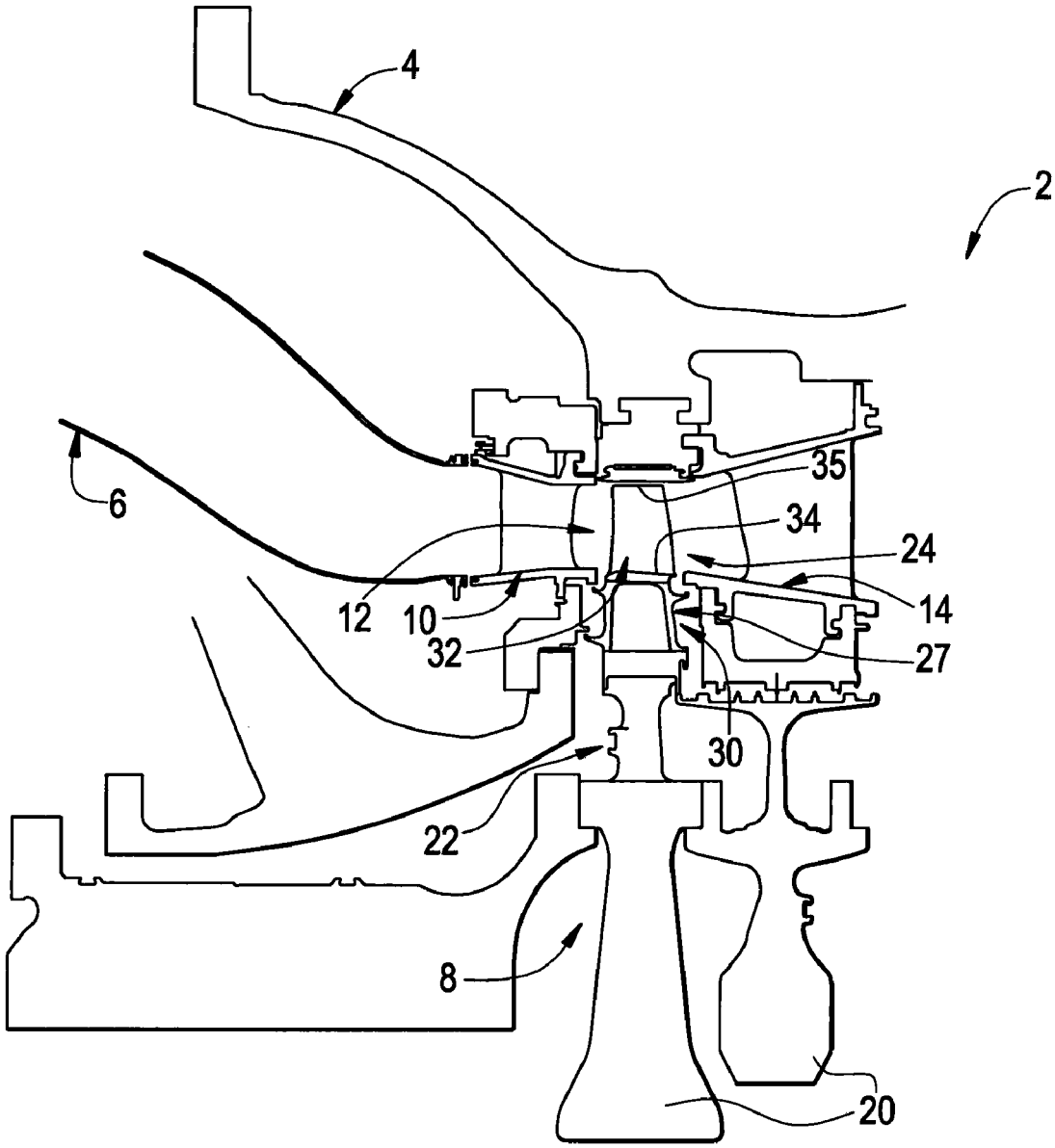
FIG. 1 is a partial, cross-sectional side view of a turbomachine including a turbine bucket constructed in accordance with an exemplary embodiment of the invention.

Referring to FIG. 1, a turbomachine constructed in accordance with the present invention is indicated generally at 2. Turbomachine 2 includes a turbine casing 4 that houses a combustion chamber 6 and a turbine stage 8. In the exemplary embodiment shown, turbine stage 8 is a first stage. Combustion gases from combustion chamber 6 pass through a first stage nozzle 10 along a hot gas path (HGP) 12 to a second stage nozzle 14. The combustion gases drive a rotor disk 20 that, in turn, drives a turbine shaft (not shown). As will be discussed more fully below, rotor disk 20 is arranged in a wheel space area 22 of turbomachine 2 and includes a plurality of turbine buckets, one of which is indicated at 24, mounted to rotor disk 20. Each turbine bucket 24 includes a main body portion 27 that defines a base portion 30, and an airfoil portion 32. Airfoil portion 32 includes a first end section 34 and a second end section 35. The combustion gases passing along hot gas path 12 push airfoil portion 32 circumferentially causing rotor disk 20 to rotate.

Figure 2:
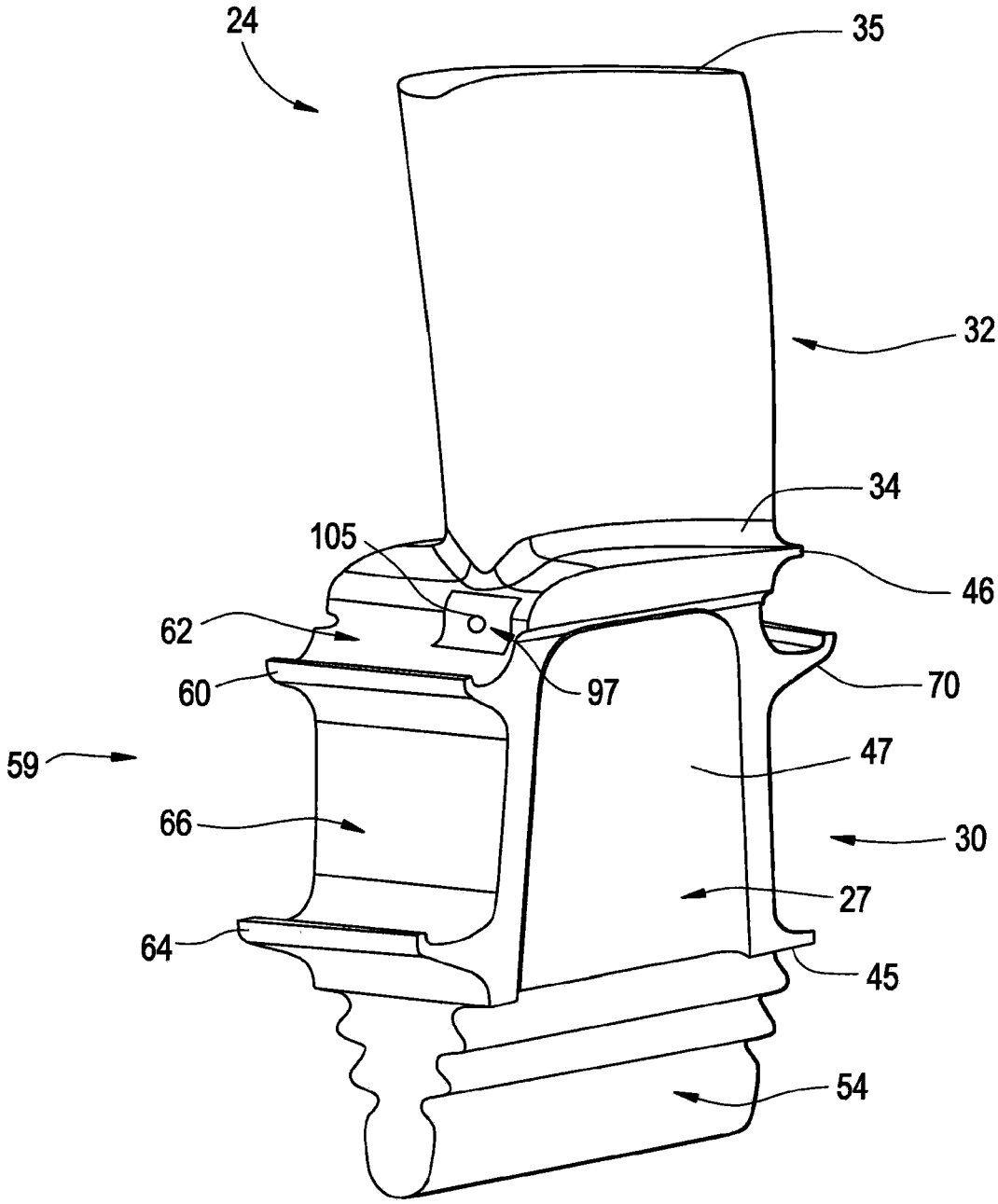
FIG. 2 is a right perspective view of a turbine bucket constructed in accordance with an exemplary aspect of the invention.

Reference will now be made to FIG. 2 in describing turbine bucket 24 constructed in accordance with a first exemplary aspect of the invention. As shown, base portion 30 includes a first end section 45 that extends to a second end section 46 through an intermediate section or shank cavity 47. A mounting member 54 is mounted to base portion 30 at first end section 45. Mounting member 54 serves as an interface between turbine bucket 24 and rotor disk 20. In addition, base portion 30 includes a bucket cavity forward region 59 including a first angel wing 60 that extends outward toward first stage nozzle 10 to define a trench cavity 62. Bucket cavity forward region 59 further includes a second angle wing 64 that also extends toward first stage nozzle 10 to define a buffer cavity 66. A third angel wing 70 extends outward from an opposing side (not separately labeled) of base portion 30 toward second stage nozzle 14. Angel wings 60, 62 and 70 provide structure that prevents, or at least substantially reduces, hot gases flowing along HGP 12 from entering wheel space area 22.

Figure 3:
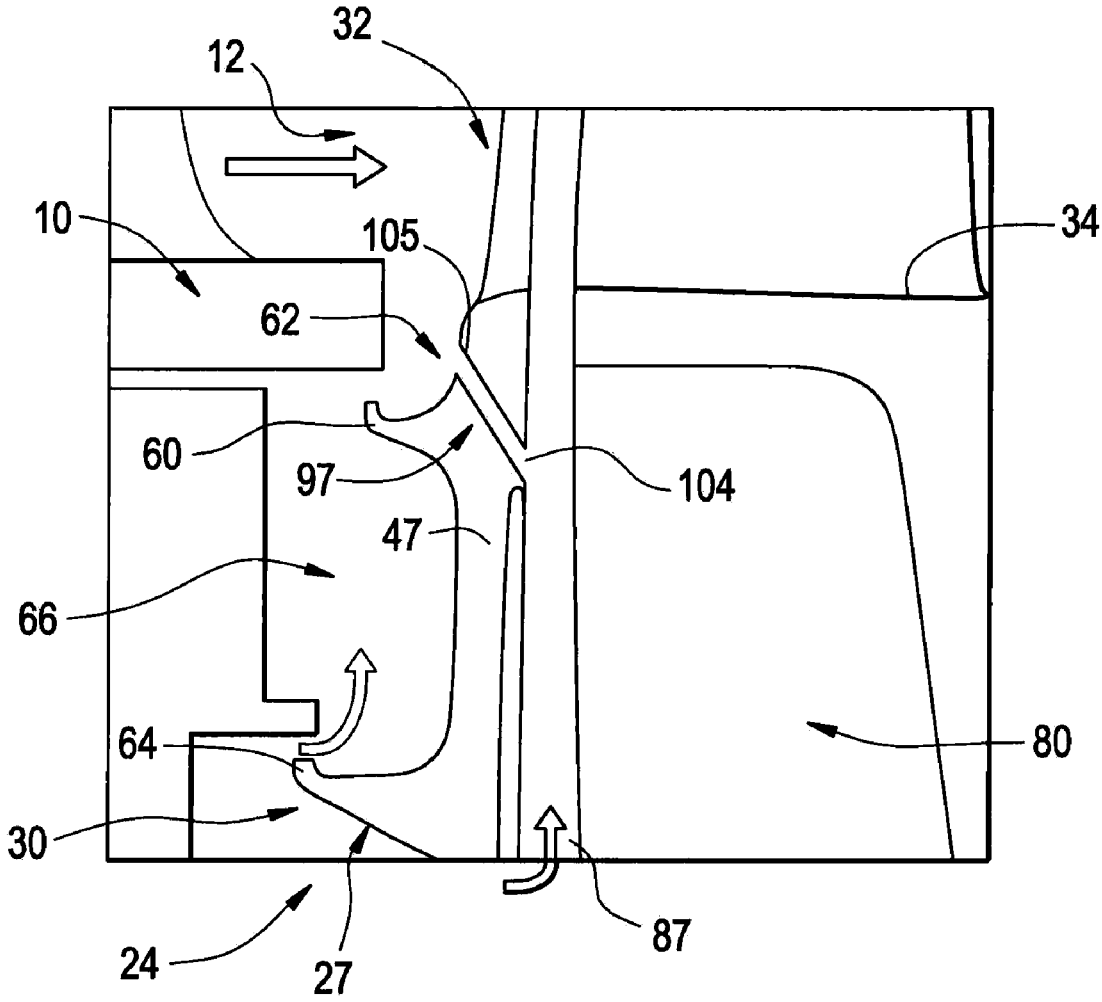
FIG. 3 is a partial, cross-sectional side view of the turbine bucket of FIG. 2.
Figure 4:
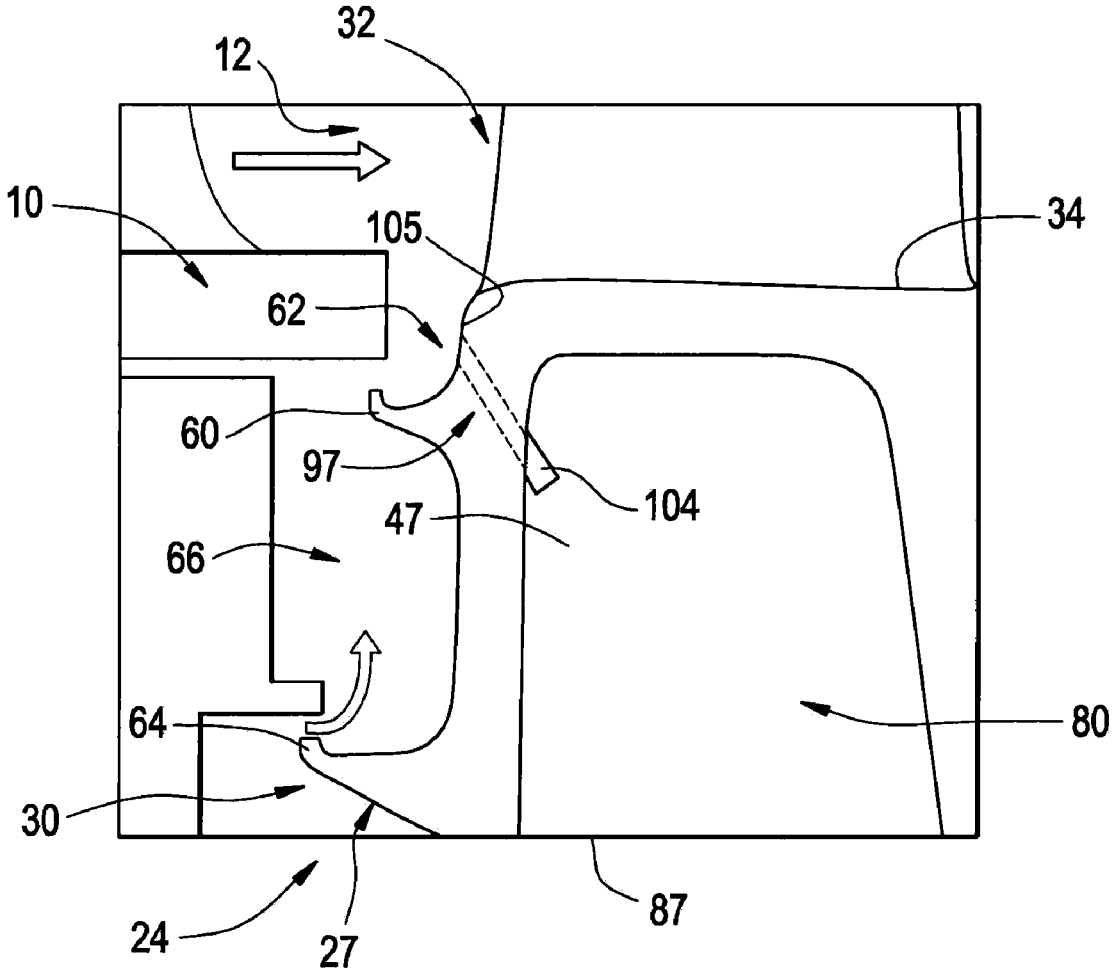
FIG. 4 is a right perspective view of a turbine bucket constructed in accordance with another exemplary embodiment of the invention.

As best shown in FIG. 3, base portion 30 includes an interior portion having a bucket cooling channel 87. Cooling channel 87 extends through base portion 30 and into airfoil portion 32. Bucket cooling channel 87 delivers a flow of cooling fluid, e.g. cooling gases, through turbine bucket 24. The cooling fluid is passed through select sections of airfoil portion 32 to maintain temperatures at desired levels. In accordance with the exemplary aspect shown, turbine bucket 24 includes a flow passage 97 that extends from bucket cooling channel 87, through main body portion 27, and opens toward trench cavity 62. Towards that end, flow passage 97 includes a first end 104 fluidly connected to bucket cooling channel 87 and a second end 105 that leads toward trench cavity 62. In accordance with another exemplary aspect of the invention, flow passage 97 extends between shank cavity 47 and opens toward trench cavity 62 as illustrated in FIG. 4. As will be detailed more fully below, flow passage 97 delivers a jet or flow of cooling fluid or gas from bucket cooling channel 87 toward trench cavity 62.

A high pressure region of turbine bucket 24 is located above trench cavity 62 and in front of a leading edge (not separately labeled) of airfoil portion 32. The high pressure region is the result of a bow wave caused by a leading edge of turbine bucket 24 rotating through the high temperature, high pressure gases. The bow wave drives hot gases into an axial gap (not separately labeled) that extends between angel wing 60 and first stage nozzle 10. The hot gases passing into the axial gap may be ingested into buffer cavity 66 and even as far as wheel space area 22. In order to eliminate, or at least substantially reduce, the flow of hot gases into the axial gap, a flow of cooling fluid or gas is directed into first end 104 of flow passage 97. The cooling gas passes out second end 105 toward trench cavity 62. The flow of cooling gas entering trench cavity 62 opposes or disrupts air stagnating at the axial gap to reduce hot gas ingestion. In addition, the flow of cooling gas mixes with high pressure hot gases produced by the bow wave before the high pressure hot gases enter trench cavity 62. Furthermore, the cooling gas traversing through flow passage 97 can convectively cool turbine bucket 24. In this manner, any gases that actually pass through the axial gap are tempered by the cooling gas. Tempering the hot gases passing through the axial gap reduces any detrimental effect the hot gases may have on components in wheel space area 22.

Figure 5:
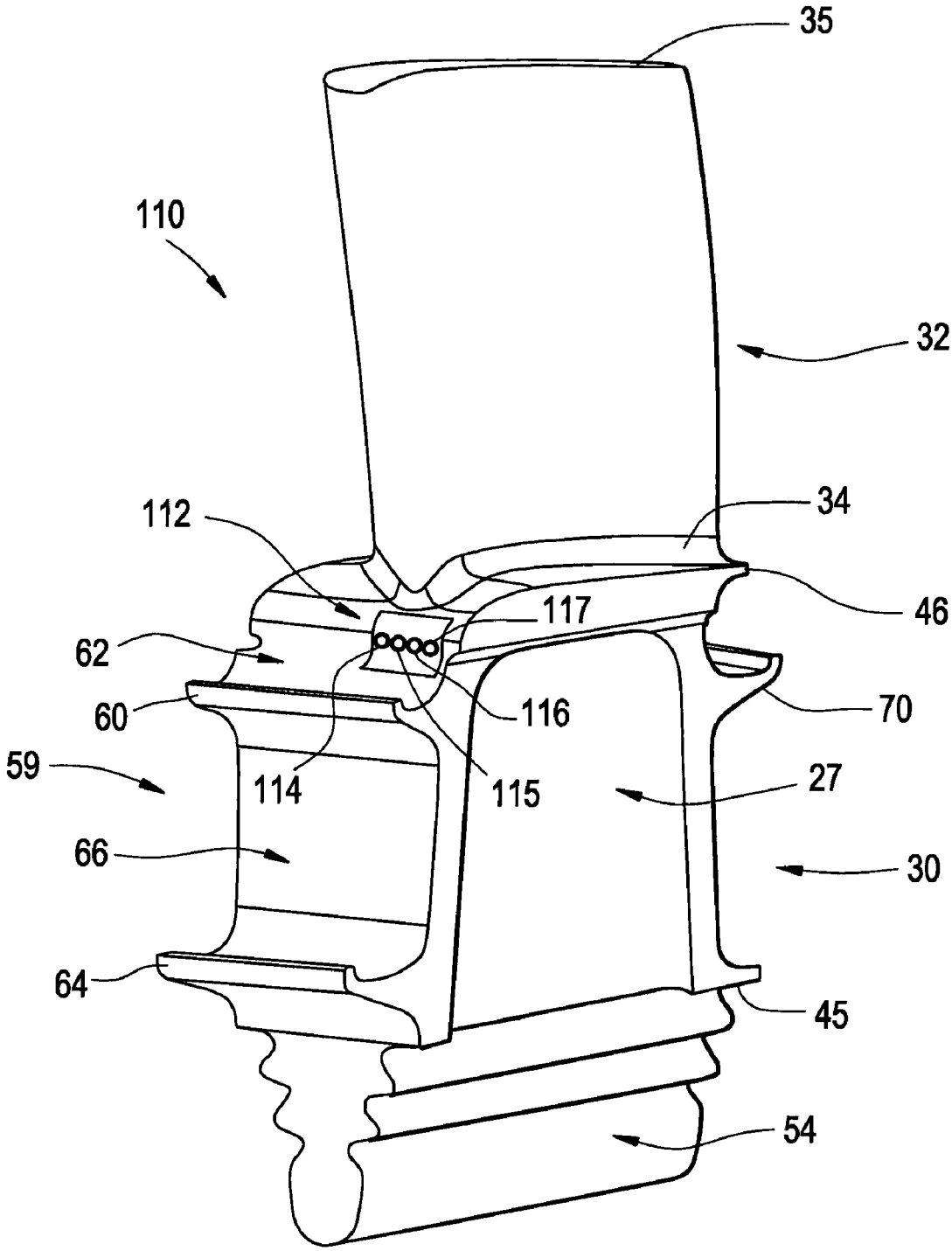
FIG. 5 is a right perspective view of a turbine bucket constructed in accordance with another exemplary aspect of the invention.

Reference will now be made to FIG. 5, wherein like reference numbers represent corresponding parts in the respective views, in describing a turbine bucket 110 constructed in accordance with another exemplary aspect of the invention. As shown, turbine bucket 110 includes a plurality of flow passages 112 that deliver jets of cooling gas toward trench cavity 66. More specifically, turbine bucket 110 includes a first flow passage 114, a second flow passage 115, a third flow passage 116 and a fourth flow passage 117 all of which are arranged along a single row that extends above trench cavity 62. Flow passages 114-117 are configured to deliver multiple streams or jets of cooling gas toward trench cavity 62 to oppose the high pressure hot gases produced by the bow wave. In a manner similar to that described above, the multiple jets of cooling gas reduce hot gas ingestion. In addition, the multiple jets of cooling gas mix with the high pressure hot gases produced by the bow wave before the high pressure hot gases enter trench cavity 62. Furthermore, the cooling gases traversing through flow passage 97 can convectively cool turbine bucket 110. In this manner, any high pressure hot gases that actually pass through the axial gap are tempered by the cooling gases. Tempering the high pressure hot gases passing through the axial gap reduces any detrimental effect the high pressure hot gases may have on various components in wheel space area 22.

Figure 6:
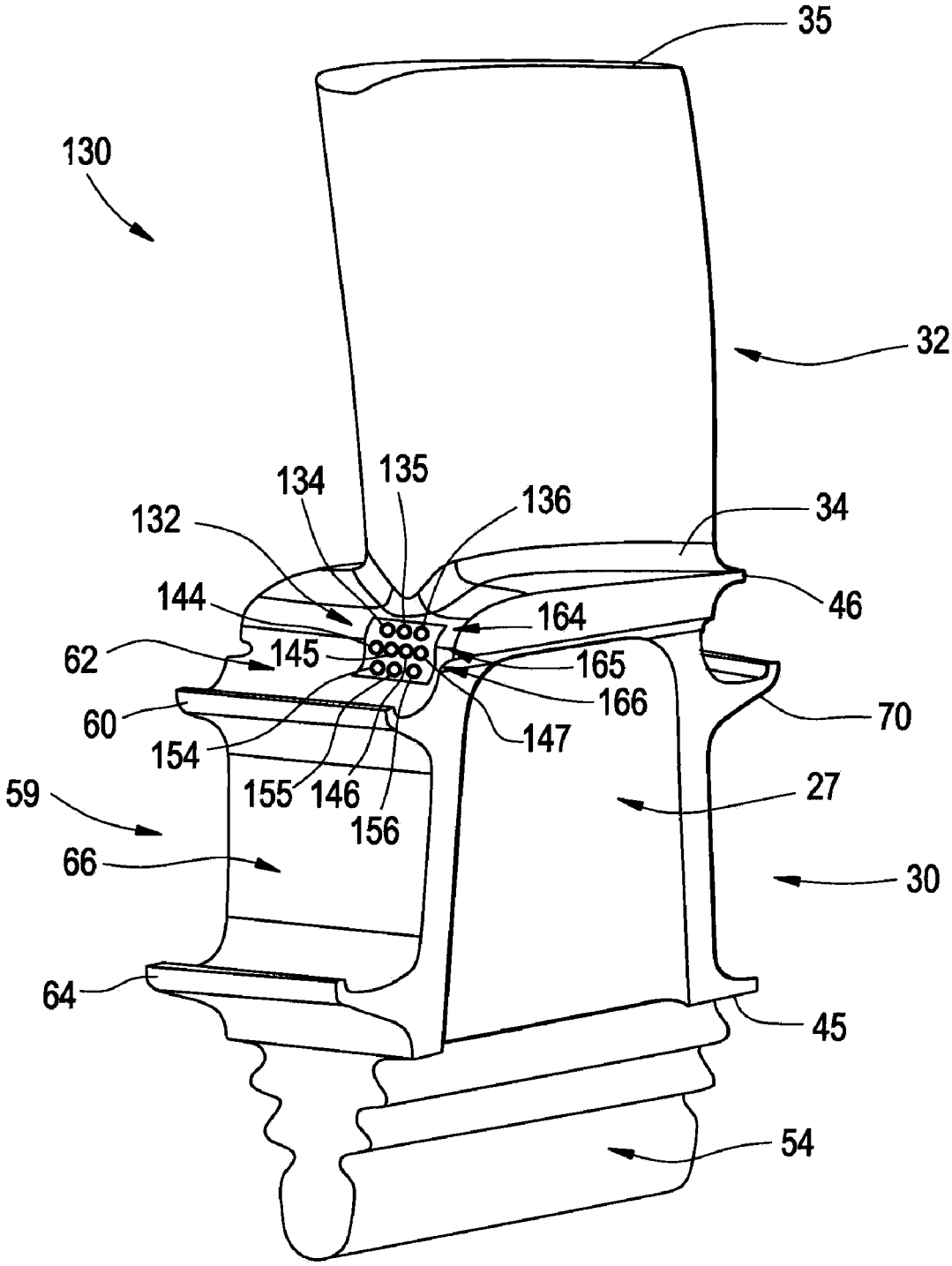
FIG. 6 is a right perspective view of a turbine bucket constructed in accordance with yet another exemplary aspect of the invention.

Reference will now be made to FIG. 6, wherein like reference numbers represent corresponding parts in the respective views, in describing a turbine bucket 130 constructed in accordance with another exemplary aspect of the invention. As shown, turbine bucket 130 includes a plurality of flow passages 132 that deliver jets of cooling gas toward trench cavity 62. More specifically, turbine bucket 130 includes a first plurality of flow passages 134-136, a second plurality of flow passages 144-147 and a third plurality of flow passages 154-156. Flow passages 134-136 are arranged along a first row 164 that extends above trench cavity 62, flow passages 144-147 are arranged along a second row 165 that extends above trench cavity 62 adjacent first row 164, and flow passages 154-156 are arranged along a third row 166 that extends above trench cavity 62 adjacent second row 165. With this configuration, multiple jets of cooling gas are directed toward trench cavity 62 to reduce hot gas ingestion. In addition, the multiple jets of cooling gas mix with the high pressure hot gases produced by the bow wave and cause a temperature reduction in the high pressure hot gases. Furthermore, cooling gases traveling through flow passages 132 can convectively cool turbine bucket 130. In this manner, any high pressure hot gases that actually pass through the axial gap are tempered by the multiple jets of cooling gas. Tempering the high pressure hot gases passing through the axial gap reduces any detrimental effect the high pressure hot gases may have on components in wheel space area 22.

Figure 7:
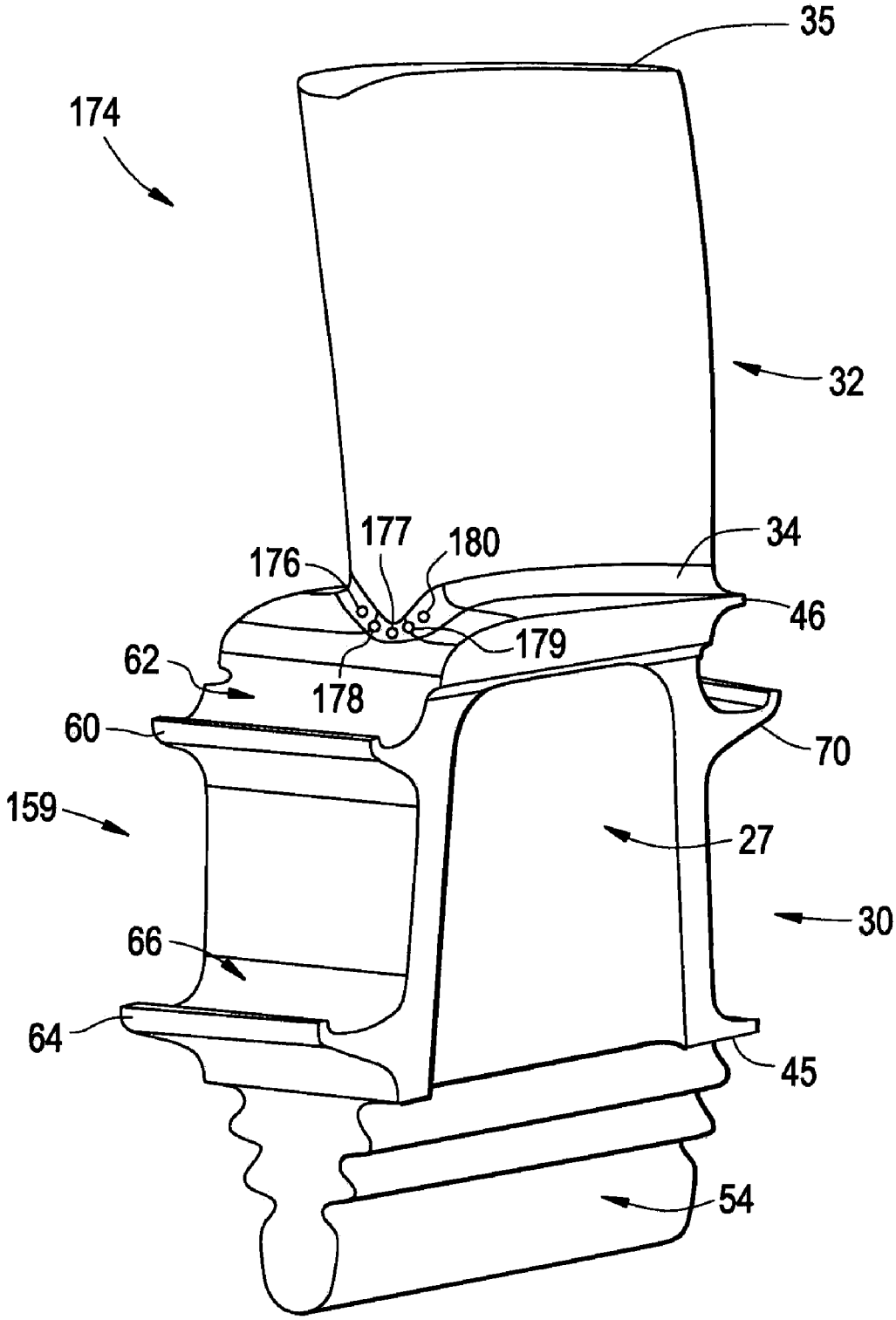
FIG. 7 is a right perspective view of a turbine bucket constructed in accordance with still another exemplary aspect of the invention.

Reference will now be made to FIG. 7, wherein like reference numbers represent corresponding parts in the respective views, in describing a turbine bucket 174 constructed in accordance with another exemplary aspect of the invention. As shown, turbine bucket 174 includes a plurality of flow passages 176-180. Flow passages 176-180 area arranged along a single row (not separately labeled) at an interface (not separately labeled) between base portion 30 and airfoil portion 32. Flow passages 176-180 direct multiple jets of cooling gas around both a leading edge portion (not separately labeled) of turbine bucket 174 as well as toward trench cavity 62. The multiple jets of cooling gas not only reduce high pressure hot gas ingestion, but cause a temperature reduction in the high pressure hot gases produced by the bow wave. Furthermore, the cooling gas traveling through flow passages 176-180 can convectively cool turbine bucket 174. In this manner, any high pressure hot gases that actually pass through the axial gap are tempered by the multiple jets of cooling gas. Tempering the high pressure hot gases passing through the axial gap reduces any detrimental effect the high pressure hot gases may have on components in wheel space area 22.

At this point it should be understood that the turbine bucket constructed in accordance with the exemplary aspects of the invention reduces high pressure hot gas ingestion into wheel space regions of the turbine. The high pressure hot gases caused by the bow wave are disrupted and/or tempered through mixing by one or more jets of cooling fluid or gas. Additionally, the cooling fluid or gases traveling through the one or more flow passages can convectively cool the turbine bucket. The one or more jets of cooling gas reduce any harmful effects the high pressure hot gases could have on turbine components. It should also be appreciated the particular number, location and arrangement of the flow passage(s) can vary in accordance with exemplary aspects of the invention in order to reduce cooling gas diversion and target specific regional locations. Finally, it should be appreciated the exemplary embodiments of the invention can be employed in conjunction with thermal barrier coatings on various portions of the turbine bucket in order to further reduce heat flux.

In general, this written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of exemplary embodiments of the present invention if they have structural elements that do not differ from the literal language of the claims, or if they include equivalent structural elements with insubstantial differences from the literal language of the claims.

The invention claimed is:

1. A turbine bucket for a turbomachine, the turbine bucket comprising:

a main body portion including a base portion and an airfoil portion, the base portion including a bucket cavity forward region having a trench cavity and a shank cavity;

a cooling channel extending through the main body portion; and at least one flow passage extending between one of the cooling channel and the shank cavity toward the bucket cavity forward region, the at least one flow passage including an outlet arranged in the bucket cavity forward region between the trench cavity and the airfoil portion, the outlet being configured to deliver a flow of cooling gas outward from the bucket cavity forward region to limit ingestion of hot gases into the bucket cavity forward region.

2. The turbine bucket according to claim 1, wherein the at least one flow passage comprises a plurality of flow passages arranged along a single row that extends along at least a portion of the bucket cavity forward region.

3. The turbine bucket according to claim 1, wherein the at least one flow passage comprises a plurality of flow passages arranged in multiple rows that extend along at least a portion of the bucket cavity forward region.

4. The turbine bucket according to claim 1, wherein the at least one flow passage extends between the cooling channel and the bucket cavity forward region at an interface between the airfoil portion and the base portion.

5. The turbine bucket according to claim 1, wherein the bucket cavity forward region includes a trench cavity and a buffer cavity, the at least one flow passage extending between the cooling channel and toward the trench cavity.

6. The turbine bucket according to claim 5, wherein, the at least one flow passage includes a first end and a second end, the second end being arranged above the trench cavity.

7. The turbine bucket according to claim 1, wherein the flow passage is angled relative to the bucket cavity forward region.

8. A method of reducing bow wave effects at a turbine bucket, the method comprising:

delivering a cooling gas through one of a bucket cooling channel extending through the turbine bucket and along a shank cavity of the turbine bucket;

passing a portion of the cooling gas through a flow passage extending between one of the cooling channel and the shank cavity;

guiding the cooling gas from an outlet arranged on a bucket cavity forward region between a trench cavity and an airfoil portion, toward the bucket cavity forward region of the turbine bucket; and directing at least one jet of the portion of the cooling gas to oppose a local hot gas path pressure produced by a bow wave to limit ingestion of hot gases into the bucket cavity forward region.

9. The method of claim 8, further comprising: directing multiple jets of the portion of the cooling gas to oppose the local hot gas path pressure produced by a bow wave to limit ingestion of hot gases into the bucket cavity forward region.

10. The method of claim 8, wherein directing multiple jets of the portion of cooling gas to oppose local hot gas path pressure comprises directing a single row of jets of the portion of cooling gas to oppose the local hot gas path pressure.

11. The method of claim 8, wherein directing multiple jets of the portion of cooling gas to oppose local hot gas path pressure comprises directing multiple rows of jets of the portion of cooling gas to oppose the local hot gas path pressure.

12. The method of claim 8, wherein directing the at least one jet of the portion of cooling gas to oppose a local hot gas path pressure comprises directing the at least one jet of the portion of cooling gas toward a trench cavity portion of the bucket cavity forward portion.

13. The method of claim 12, wherein directing the at least one jet of the portion of the cooling gas to oppose a local hot gas path pressure comprises directing the at least one jet of the portion of cooling gas above the trench cavity portion.

14. The method of claim 8, further comprising: convectively cooling the turbine bucket with the cooling gases passing through the flow passage.

15. A turbomachine comprising:

a turbine stage including a rotor disk; and a plurality of turbine buckets mounted to the rotor disk, each of the plurality of turbine buckets including:

a main body portion including a base portion and an airfoil portion, the base portion including a bucket cavity forward region having a trench cavity, and a shank cavity;

a cooling channel extending through the main body portion; and at least one flow passage extending between one of the cooling channel and the shank cavity toward the bucket cavity forward region, the at least one flow passage including an outlet arranged in the bucket cavity forward region between the trench cavity and the airfoil portion, the outlet being configured to deliver a flow of cooling gas outward from the bucket cavity forward region to limit ingestion of hot gases into the bucket cavity forward region.

16. The turbomachine according to claim 15, wherein the at least one flow passage comprises a plurality of flow passages arranged along a single row that extends along at least a portion of the bucket cavity forward region.

17. The turbomachine according to claim 15, wherein the at least one flow passage comprises a plurality of flow passages arranged in multiple rows that extend along at least a portion of the bucket cavity forward region.

18. The turbomachine according to claim 15, wherein the at least one flow passage extends between the cooling channel and the bucket cavity forward region at an interface between the airfoil portion and the base portion.

19. The turbomachine according to claim 15, wherein the bucket cavity forward region includes a trench cavity and a buffer cavity, the at least one flow passage extending between the cooling channel and toward the trench cavity.

20. The turbomachine according to claim 19, wherein, the at least one flow passage includes a first end and a second end, the second end being arranged above the trench cavity.

* * * * *